US005153960A

United States Patent [19]

Ritter et al.

[11] Patent Number: 5,153,960

[45] Date of Patent: Oct. 13, 1992

[54] PILLOW FOR A BURIAL CASKET

[75] Inventors: Eugene A. Ritter; Wilbur A. Schebler; Charles F. Winburn, all of Batesville, Ind.

[73] Assignee: Batesville Casket Company, Inc., Batesville, Ind.

[21] Appl. No.: 789,656

[22] Filed: Nov. 8, 1991

[51] Int. Cl.[5] ..... A47C 20/00

[52] U.S. Cl. ..... 5/640; 5/637; 5/632; 27/13

[58] Field of Search ..... 27/13; 5/431, 434, 436, 5/437, 465, 490, 632, 637, 640; 269/328

[56] References Cited

U.S. PATENT DOCUMENTS 2,099,977 11/1937 Harris ..... 27/13
3,241,161 3/1966 Dashosh ..... 5/490 X
3,389,411 6/1968 Emery ..... 5/490
4,850,068 7/1989 Walpin et al. ..... 5/436 X

FOREIGN PATENT DOCUMENTS 328577 9/1929 United Kingdom ..... 5/437

*Primary Examiner*—Michael F. Trettel
*Attorney, Agent, or Firm*—Wood, Herron & Evans

[57] ABSTRACT

A pillow for a burial casket. The pillow is formed of a trapezoidal cross section, head block, four trapezoidal shoulder blocks that are detachable from the head block and a covering pad having a concave undersurface into which the head and shoulder blocks nest. A fabric pillow case has a transverse zipper at its upper end which is normally covered by a fabric. The zipper provides access into the interior of the pillow so as to remove and/or adjust the several blocks in order to present the deceased as attractively as possible.

9 Claims, 2 Drawing Sheets

PILLOW FOR A BURIAL CASKET

BACKGROUND OF THE INVENTION

This invention relates to a pillow for a burial casket.

The current practice in forming a pillow for a casket has been to provide a fabric container that has a zipper that is about 7 inches long. The zipper is usually placed on the front edge or side of the container so that it is not visible during normal viewing. The zipper provides an opening for stuffing the fabric container with cotton or non-woven polyester Being at the front edge of the pillow, the zipper is rather inaccessible for reaching into the interior of the pillow once the deceased has been laid upon it in order to make final adjustment for the positioning of the head and shoulders of the deceased.

There has been a need for a pillow that has a greater capability for being easily adjusted from a smooth, unwrinkled condition suitable for casket selection to a condition for supporting the head and shoulders of the deceased in a natural attitude in the casket. Furthermore, there has been a need for making final adjustment for the position of the arms of the deceased, this having been accomplished by stuffing rolled-up cotton or newspapers under the elbows of the deceased.

Further, in the process of selecting a casket suitable for the deceased, the pillow must look attractive and unwrinkled and must feel soft to the touch of the person making the selection.

An objective of the present invention has been to provide a pillow that significantly responds to the need for adjustment of the support for those portions of the deceased's body that will be viewed so as to present the deceased in as attractive an attitude as possible. The head must be placed with the chin up as contrasted to resting against the neck. The arms must not sag down into the casket.

The objective of the present invention is attained by providing a pillow having a head block for support of the head and wedge-shaped shoulder blocks that are separable from the head block. Preferably, the wedge-shaped shoulder blocks are removable and adapted to be positioned under the elbows of the deceased to raise the arms into the desired position for viewing. The head block has a removable section which, when in place, provides a smooth, unwrinkled surface, but when removed, provides a recess for positioning the head so that the chin does not rest against the neck.

The head and shoulder blocks are preferably covered by a non-woven polyester pad which is about two inches thick. The pad has a concave lower surface into which the head and shoulder blocks nest. That assembly of blocks and pad is covered with an attractive fabric pillow case. The pillow case has a zipper at its top back edge adjacent the end wall of the casket. A cover flap is attached to the pillow case and overlies the zipper, concealing it from view.

The zipper permits the funeral director to reach into the pillow case to remove as many of the foam shoulder blocks as are necessary; for example, one for the support of each elbow, and to remove the section filling the recess into which the head is to be disposed.

The head and shoulder blocks are preferably polyurethane foam with the wedges being attached along their rear edges to the head block. A single wedge of polyurethane foam is then sliced with a hot wire to form selectively the removable sections.

The polyester pad provides a soft touch for the top of the pillow and provides assurance that the casket, when viewed in the selection room, will have a smooth, wrinkle-free pillow.

BRIEF DESCRIPTION OF THE DRAWINGS

The several features and objectives of the present invention will become more readily apparent from the following detailed description taken in conjunction with the accompanying drawings in which.

DETAILED DESCRIPTION OF THE INVENTION

Figure 1:
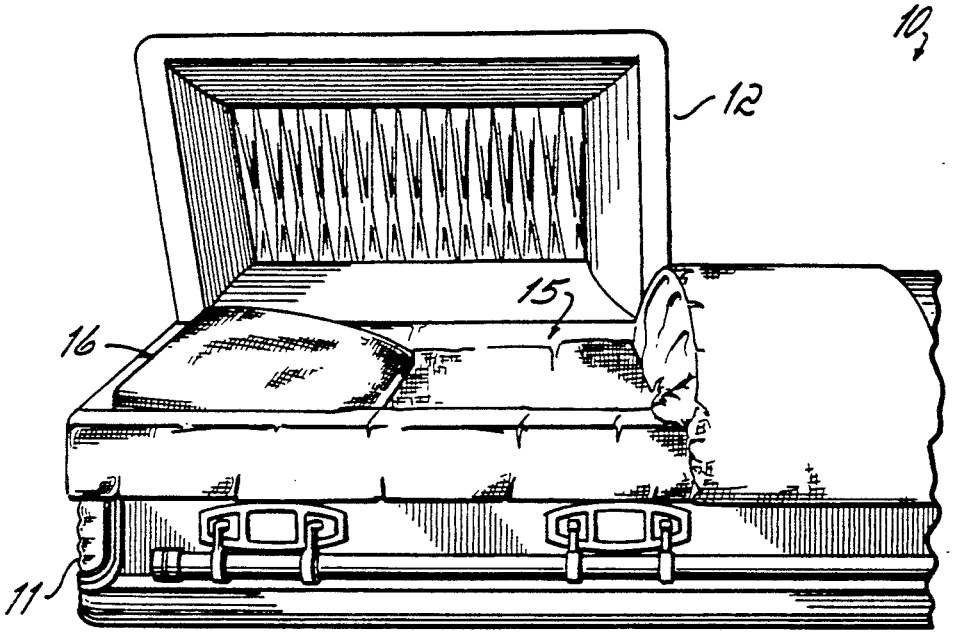
FIG. 1 is a fragmentary perspective view of the head end of a casket.
Figure 3:
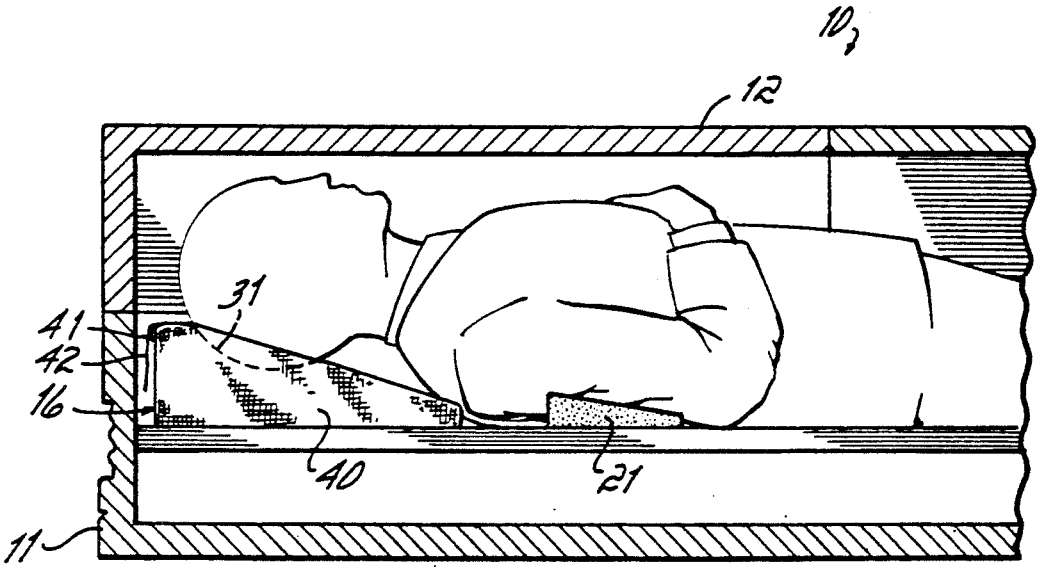
FIG. 3 is a schematic cross-sectional view of the casket supporting a deceased person.

Referring to FIG. 1, a casket 10 has a shell 11 and a lid or cap 12. The lid 12 may extend the full length of the casket or may be divided into two sections as shown in the embodiment of FIG. 1. The interior is lined with upholstery 15, the upholstery including a pillow 16.

Figure 2:
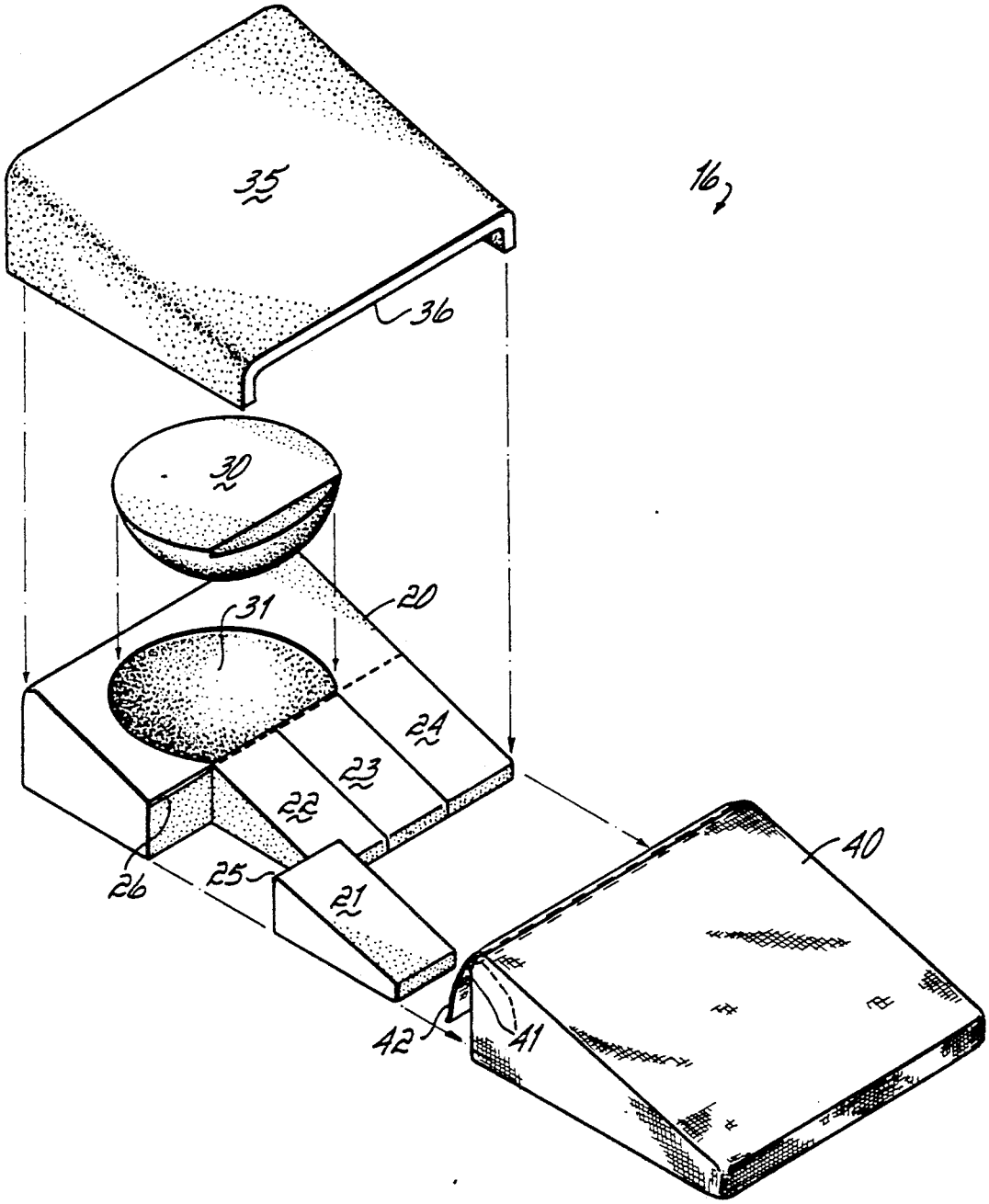
Fig. 2 is a disassembled perspective view of the pillow of the present invention.

As shown in FIG. 2, the pillow 16 has seven elements and a pillow case. The number of elements obviously can be varied without departing from the scope of the present invention. In the interior of the pillow, there is a head block 20 of generally trapezoidal cross section and four shoulder blocks 21, 22, 23, and 24. The shoulder blocks 21–24 are preferably joined to the head block 20 along adjacent edges 25 and 26, respectively. The blocks 21–24 are formed of polyurethane foam and the strip by which the shoulder blocks are joined to the head block can be about ¼ inch thick.

A removable section 30 is disposed in a cavity 31 on the upper surface of the head block. Initially, the section 30 is in place in the recess 31 so that the pillow case will be smooth and wrinkle-free (FIG. 1) but is later removed so that the head can be tilted slightly rearwardly to bring the chin up away from the neck of the deceased, as shown in Fig. 2.

Preferably, the foam blocks 21–24 are formed of one wedge-shaped block which is subsequently cut with a hot wire to form the separable parts described above. Typical dimensions for the block are that it should be about 7 inches high at the rear end of the head block and 21 inches wide and 21 inches long. The joint between the head block 20 and the shoulder blocks 21–24 is approximately midway between the two ends of the pillow.

A non-woven polyester pad 35 is about 2 inches thick. It has an undersurface 36 that is concave to snugly receive in nesting fashion the elements of the foam blocks forming the interior of the pillow. That assembly is inserted into a decorative fabric pillow case 40 which is generally wedge-shaped to conform to the shape of the foam head and shoulder blocks. A transverse zipper 41 extends across the full width of the pillow case for access to the interior of the pillow case for the adjustment features to be described. A cover flap 42 is hinged to the rear upper edge of the pillow case and is adapted to be folded over the zipper to conceal it.

In the operation of the invention, the section 30 and the shoulder blocks are initially attached with respect to the head block with the assembly being covered by the pillow case pad and inserted into the pillow case. In that condition, the pillow case presents a smooth, attractiveappearing soft touch to the pillow for display in the selection room of the funeral home.

When the deceased is placed in the casket, the funeral director reaches through the zippered opening 41 to remove the section 30 from the head cavity so that the head can be positioned in the cavity with the chin up away from the neck. The funeral director probably will remove the outboard shoulder wedges 21 and 24 to place them under the elbows of the deceased, thereby raising the forearms of the deceased so that the arms do not sag within the casket. The remaining blocks 22, 23 remain attached to the head block and support the shoulders of the deceased. The somewhat loose fabric and non-woven polyester pad that overlies the area from which the outboard wedges were removed is fluffed up around the head of the deceased for an attractive, natural-appearing support.

The invention thus has the following features:

The zipper location allows adjustment of the interior segments with the head and pillow in place in the casket while the cover flap is employed to conceal the zipper.

The removable section 30 creates a cavity for the head to provide assurance of the proper positioning of the head with respect to the neck.

The break-away foam wedges provide better shoulder support and positioning.

The outboard foam wedges, not necessary for the support of the shoulders, can be used as elbow supports to present the arms of the deceased attractively.

The non-woven polyester pad provides a soft touch for the top and provides assurance of the taking out of the wrinkles of the pillow case when the pillow is in the casket as it is being displayed for selection.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A pillow for a casket comprising:

a plurality of separable blocks normally assembled along parting lines into a pillow shape, and a flexible cover for encasing said blocks and concealing said parting lines of said blocks, a selected portion of said blocks being removable to distribute the blocks for the best support of a deceased person's head, shoulders and arms, said cover comprising a pad, having a concave undersurface and overlying said blocks, said blocks nesting within said undersurface, said pad resisting collapse over areas from which blocks have been removed, and a pillow case surrounding said blocks and pad.

2. A pillow for a casket as in claim 1 in which said pillow case has a zipper permitting access to said blocks, and a flap overlying said zipper.

3. A pillow for a casket comprising:

a head block, a plurality of wedge-shaped shoulder blocks, having large ends butting said head block, a pad having a concave undersurface overlying said blocks with said blocks normally nesting within said undersurface, and a decorative pillow case surrounding said blocks.

4. A pillow as in claim 3, in which said blocks are cut from polyurethane foam, said head block having a recess to receive a head of a deceased.

5. A pillow as in claim 4, said shoulder blocks being initially attached to said head block along a thin strip of foam.

6. A pillow as in claim 4, further comprising:

a removable section initially disposed in said recess to provide a smooth wrinkle-free surface for the purpose of casket selection.

7. A pillow as in claim 3, further comprising:

a zippered opening extending across the end of the pillow case adjacent the head block, and a fabric flap adapted to cover said zippered opening.

8. A pillow for a casket comprising:

a head block, a plurality of wedged shaped shoulder blocks, having large ends abutting said head block, said shoulder blocks including two outboard blocks, each said outboard block being removable and positionable under an elbow of a deceased, while said shoulder blocks remaining abutted to said head block support a shoulder area of the deceased, and a decorative pillow case surrounding said blocks.

9. A pillow for a casket comprising:

a head block, a plurality of wedge shaped shoulder blocks, having large ends abutting said head block, said head block having a removable section initially disposed within a recess which, when removed, forms a cavity that receives a head of a deceased so as to tilt a chin of the head up and away from a chest of the deceased, and a decorative pillow case surrounding said blocks.

* * * * *